United States Patent [19]

Miyata

[11] 4,340,493

[45] Jul. 20, 1982

[54] DETERGENT-DISPERSANT COMPOSITION FOR LUBRICATING OR FUEL OILS

[75] Inventor: Shigeo Miyata, Takamatsu, Japan

[73] Assignee: Kyowa Chemical Industry Co. Ltd., Tokyo, Japan

[21] Appl. No.: 259,432

[22] Filed: May 1, 1981

[30] Foreign Application Priority Data

Mar. 14, 1980 [JP] Japan ..... 55/31682

[51] Int. Cl.[3] ..... C10M 1/10; C10M 3/02

[52] U.S. Cl. ..... 252/18; 423/419 P; 44/51; 44/67

[58] Field of Search ..... 423/419 P; 424/156, 424/157; 252/33.3, 18; 44/51, 67

[56] References Cited

U.S. PATENT DOCUMENTS

| | | | |
|---|---|---|---|
| 2,890,108 | 6/1959 | Toulmin | 44/67 |
| 3,099,524 | 7/1963 | Grossmith | 423/419 P |
| 3,514,273 | 5/1970 | Lee | 44/51 |
| 3,692,503 | 9/1972 | Kukin | 44/51 |

*Primary Examiner*—Richard L. Schilling
*Assistant Examiner*—Hoa Van Le
*Attorney, Agent, or Firm*—Sherman & Shalloway

[57] ABSTRACT

A detergent-dispersant composition for lubricating or fuel oils, said composition consisting essentially of (a) an amount effective as a detergent-dispersant of a hydrotalcite having a specific surface area, determined by the BET method, of up to about 60 $m^2/g$ and an average secondary particle size of up to about 5 microns, the hydrotalcite particles being untreated or surface-treated with an anionic surface-active agent, and the hydrotalcite being represented by the following formula $$Mg_xAl_2(OH)_{6+2x-2y}(CO_3)_y \cdot mH_2O$$

wherein x is a positive number represented by $3<x<20$, y is a positive number represented by $0<y<2$, and m is a positive number of up to 7, and (b) a hydrophobic dispersant or diluent.

7 Claims, No Drawings

DETERGENT-DISPERSANT COMPOSITION FOR LUBRICATING OR FUEL OILS

This invention relates to a detergent-dispersant composition which is important as an additive to lubricating or fuel oils. Specifically, it relates to a detergent-dispersant composition for lubricating or fuel oils which exhibits an outstanding overbasing ability, an excellent ability to maintain an ultrafinely dispersed state, has excellent affinity for, and dispersibility in, lubricating or fuel oils, can be blended by a very easy operation in use, and can exhibit an excellent detergent-dispersant effect.

More specifically, this invention pertains to a detergent-dispersant composition for lubricating or fuel oils, said composition consisting essentially of (a) an amount, effective as a detergent-dispersant, of a hydrotalcite having a specific surface area, determined by the BET method, of up to about 60 $m^2/g$, preferably up to about 40 $m^2/g$ and an average secondary particle size of up to about 5 microns, preferably up to about 1 micron, the hydrotalcite particles being untreated or surface-treated with an anionic surface-active agent, and the hydrotalcite being represented by the following formula $$Mg_xAl_2(OH)_{6+2x-2y}(CO_3)_y \cdot mH_2O \quad (1)$$

wherein x is a positive number represented by $3<x<20$, y is a positive number represented by $0<y<2$, and m is a positive number of up to 7, and (b) a hydrophobic dispersant or diluent.

The detergent-dispersant composition has been widely used as an additive to lubricating or fuel oils in order to neutralize undesirable corrosive acidic pollutant substances resulting from oxidation or incomplete combustion of these oils and finely disperse the resulting insoluble substances in the oils thereby preventing these substances from being flocculated into a deposit which may cause various troubles, and also to maintain an engine clean and prevent rust formation at metallic parts which have low corrosion resistance.

Usually, such a detergent-dispersant composition is used in combination with a hydrophobic (oil-soluble or oil-miscible) dispersant, a hydrophobic diluent, a overbasing agent and other additives. In use, it is frequently in the form of a fine colloidal dispersion composed of the hydrophobic dispersant and the overbasing agent dissolved in, or mixed with, the hydrophobic diluent.

There has been an increasingly rigorous requirement for improving the properties of such a detergent-dispersant composition, and the afforesaid overbasing agent is required to have an alkali value (AV) [the amount in milligrams of KOH per gram equivalent] of at least 250 per gram equivalent in the form of overbased sulfonate added to a hydrophobic dispersant, a hydrophobic diluent, etc. It is also required that the detergent-dispersant composition, while containing a basic compound having such an alkali value, should not cause flocculation, precipitation, separation, etc. of the basic compound and should be maintained in such an ultrafinely dispersed condition as not to be removed from lubricating or fuel oils in an in-line filtering device such as an automotive oil filter.

Conventional means cmployed in an effort to achieve the best possible dispersed state and to meet the aforesaid requirements of the detergent-dispersant additive as much as possible have the defect of requiring a complex operational process and a meticulous control of conditions for preparation of such a detergent-dispersant additive. For example, such a conventional means requires a complex process which comprises mixing, for example, an oxide or hydroxide of magnesium, water and/or an alcohol, a dispersant such as an alkylbenzene sulfonate salt in a diluent oil, and a petroleum solvent, introducing carbon dioxide into the mixture until the oxide or hydroxide of magnesium is converted to a carbonate, and then removing water, the alcohol, the petroleum solvent and non-dispersed particles. In addition, many conditions for this process, such as the temperature, the type and amount of the solvent, the type and amount of the oxide or hydroxide and the type and amount of the dispersant should be controlled with utmost and meticulous care. The process also has the disadvantage that the yield of a product being free from clouding and having such a low viscosity as to permit easy filtration is not always high.

The present inventors made investigations in order to remove the aforesaid defect and disadvantage in detergent-dispersant compositions for lubricating or fuel oils. These investigations have led to the discovery that a hydrotalcite untreated or sulface-treated with an anionic surface-active agent, particularly a hydrotalcite of formula (1) with or without surface-treatment with an anionic surface-active agent, which has not been suggested at all in conventional magnesium containing overbasing agents such as magnesium carbonate (Japanese Laid-Open Patent Publication No. 144404/1979), a basic complex of magnesium (Japanese Laid-Open Patent Publication No. 154705/1979), magnesium peroxyhydrate (Japanese Laid-Open Patent Publication No. 112399/1979) and magnesium hydroxide, is a very useful and interesting active component of a detergent-dispersant composition for lubricating or fuel oils, which exhibits an outstanding overbasing ability, an excellent ability to maintain an ultrafinely dispersed state, has excellent affinity for, and dispersibility in, lubricating or fuel oils, and can exhibit an excellent degergent-dispersant effect without involving the aforesaid disadvantageous operating process and without the need for the meticulous control.

We have found that a detergent-dispersant composition for fuel or lubricating oils having the aforesaid excellent properties can be easily formed by a simplified operation of adding it to a hydrophobic dispersant such as an oil-soluble sulfonate dissolved in or mixed with a hydrophobic diluent such as a diluent oil and simply stirring the mixture, or if desired, performing the stirring after removing water from the mixture.

Furthermore, the active component of the composition of this invention advantageously reacts with undesirable acidic pollutant substances in lubricating or fuel oils much more rapidly than conventional overbasing agent such as magnesium carbonate, calcium carbonate, barium carbonate, magnesium hydroxide, a carbonic acid complex of magnesium or a magnesium peroxide, and exhibits a high level of affinity for these oils and the hydrophobic dispersant. Furthermore, it exhibits a good ability to disperse in these oils by itself without the aid of such a dispersant, and does not undergo flocculation, precipitation and separation. The hydrotalcite component in accordance with this invention further shows an alkali value (AV) of at least 250 in these oils and can maintain a high-concentration stable ultrafine colloidal dispersion in these oils.

It has also been found in accordance with this invention that the outstanding unique properties of the hydrotalcite of formula (1) as an active component of a detergent-dispersant composition for lubricating or fuel oils are exhibited especially outstandingly in these oils when the hydrotalcite of formula (1) has a specific surface area, determined by the BET method, of not more than about 60 $m^2/g$, preferably not more than about 40 $m^2/g$, particularly not more than about 30 $m^2/g$ and an average secondary particle size of not more than about 5 microns, particularly not more than about 1 micron.

It is an object of this invention therefore to provide a detergent-dispersant composition for lubricating or fuel oils which can exhibit an excellent and unique detergent-dispersant effect.

The above and other objects and advantages of this invention will become more apparent from the following description.

The active ingredient of the composition of this invention is a hydrotalcite of the following formula $$Mg_xAl_2(OH)_{6+2x-2y}(CO_3)_y \cdot mH_2O \quad (1)$$

wherein x is a positive number represented by $3<x<20$, y is a positive number represented by $0<y<2$, and m is a positive number, with or without surface-treatment with an anionic surface-active agent, which has a specific surface area, determined by the BET method, of not more than about 60 $m^2/g$, preferably not more than about 40 $m^2/g$, especially preferably not more than about 30 $m^2/g$, and an average secondary particle size of not more than about 5 microns, preferably not more than about 1 micron.

In the above formula, m is not particularly limited, but for example, up to 7, preferably about 2 to 6. Furthermore, x in the formula is preferably $4 \leqq x \leqq 8$.

If the BET specific surface area of the hydrotalcite exceeds about 60 $m^2/g$, the crystal grains are fine particles having a size of less than about 0.1 micron, but on the other hand, its flocculating action becomes excessive, and even in an oil, forms secondary particles having an average size of, for example, more than about 10 microns. This is likely to lead to precipitation even with the aid of a hydrophobic dispersant. Hence, such a specific surface area is not suitable in the present invention. In order to obtain the aforesaid satisfactory and unique detergent-dispersant effect in oils, it is recommended to use a hydrotalcite of formula (1), with or without surface-treatment with an anionic surface-active agent, which has a BET specific surface area of not more than about 60 $m^2/g$, for example about 60 to about 10 $m^2/g$, preferably not more than about 40 $m^2/g$, especially not more than about 30 $m^2/g$, and an average secondary particle size of not more than about 5 microns, for example about 5 to about 0.01 micron, preferably not more than about 1 micron.

The average secondary particle diameter in the present invention is a value measured by the following method.

About 0.5 to 1 mg of a sample hydrotalcite is put on a glass plate, and the same amount of a dispersing medium ("Dislite", a trademark for a Vaseline-type dispersant made by Oken Shoji Sha) is added, followed by kneading. The mixture is then diluted uniformly with a small amount of cyclohexanol. One drop of the diluted mixture is put on a glass slide. A cover glass is put on it and lightly pressed. Under an optical microscope, an image of the diluted mixture on a scale of 400× is analyzed by using a RUZEX 401 particle counter. The average secondary particle diameter of the sample is defined as that particle size which corresponds to a cumulative percentage of 50 in the normal distribution of the sample determined by using the analyzed value.

Preferably, the hydrotalcite in accordance with this invention is coated at its surface with an anionic surface-active agent. This surface-treatment serves to further increase the compatibility or dispersibility of the hydrotalcite with or in a dispersant and/or a lubricating or fuel oil and to form a more stable fine colloidal suspension in good yields. Moreover, it prevents the hydrotalcite from tending to form secondary particles, and in the event secondary particles are formed, the undesirable increase in the size of the secondary size is prevented.

Examples of the anionic surfactant are alkali metal salts of higher fatty acids and alkali metal salts of hydrocarbon sulfonic acids. Specific examples of the surfactants include alkali metal salts of fatty acids having 10 to 30 carbon atoms such as sodium or potassium stearate, sodium or potassium oleate, sodium or potassium palmitate, sodium or potassium linolate and sodium or potassium linolenate; and alkali metal salts of hydrocarbon sulfonic acids having 10 to 30 carbon atoms such as sodium or potassium laurylbenzenesulfonate, sodium or potassium butylnaphthalenesulfonate and sodium or potassium dipropylnaphthalenesulfonate. These surfactants may be used singly or in combination with each other.

The surface treatment of the hydrotalcite with such an anionic surfactant can be effected, for example, by suspending a powder of the hydrotalcite of formula (1) in water, fully stirring the suspension, adding an aqueous solution of the anionic surfactant to the stirred suspension, and stirring the mixture fully for about 30 minutes to several hours, for example. The temperature of the aqueous solution of the surfactant used is above a point at which the surfactant dissolves fully. Alternatively, the surface treatment can be performed by adding a powder of the hydrotalcite to an aqueous solution of the anionic surfactant. After the surface treatment, the treated product may, as required, be subjected to such an operation as dehydration, washing with water, dehydration, and drying.

The suitable amount of the anionic surfactant used in surface-treating the hydrotalcite is about 1 to about 10% by weight, preferably about 2 to about 6% by weight, based on the weight of the hydrotalcite.

The active ingredient of this invention can be used as a detergent-dispersant composition for lubricating or fuel oils in combination with a hydrophobic dispersant, a hydrophobic diluent and other additives which are well known in the art.

Such a hydrophobic (oil-soluble or oil-miscible) dispersant is, for example, a salt of a hydrophobic sulfonic acid. Specific examples of such salts are those obtained by sulfonating alkylbenzenes having a molecular weight of about 300 to about 700. Both naturally occurring and synthetic alkylbenzenes are suitable for this purpose. Many petroleum fractions within the range of lubricating oils contain alkylbenzene components which can be converted to oil-soluble sulfonic acids by treatment with fuming sulfuric acid. The terms "petroleum sulfonates" and "mahogany sulfonates" denote oil-soluble sulfonates of such natural derivatives. Alkylbenzenes having a preferred molecular weight range can be synthesized by reacting benzene with chloroparaffins or olefins using Friedel-Crafts catalysts such as aluminum chloride. Preferred alkylbenzenes may also be obtained as by-products of other chemical processes. For example, in the manufacture of household detergents, benzene is alkylated with a mixture of $C_{10}$–$C_{15}$ chloroparaffins. The monoalkylbenzene (linear alkylate) as a main product is sulfonated and neutralized with sodium hydroxide to form a water-soluble detergent. Distillation bottoms as by-products containing dialkylbenzenes, dialkyltetralins and diphenylalkanes are sulfonated and neutralized with, for example, magnesium oxide to form oil-soluble sulfonate dispersants. In many cases, it is preferred to use a mixture of at least two different sulfonates as in a combination of a petroleum sulfonate derived from a natural product and a synthetic product.

In the present invention, sulfonic acid may occasionally be used instead of the sulfonate. In this case, a hydrotalcite is added in an excessive amount sufficient to neutralize the sulfonate. It is also possible in this invention to use other sulfonate salts such as calcium sulfonate or barium sulfonate. Other oil-soluble sulfonates such as dinonyl naphthalenesulfonates are also useful. As is well known, in addition to the sulfonates, many other oil-soluble dispersants such as alkyl phenates and high-molecular-weight carboxylic acid salts, alkyl phosphonates and alkenyl succinimides are available. They may replace a part or the whole of the sulfonate in the present invention.

Since an oil-soluble sulfonate salt, in a pure condition, is normally a vitreous semi-solid, it is usually supplied and handled as a solution in a hydrophobic (oil-soluble or oil-miscible) diluent.

Examples of hydrophobic diluents which can be used in this invention include aliphatic or alicyclic hydrocarbons having 5 to 20 carbon atoms including halogenated hydrocarbons, such as heptane, hexane, petroleum naphtha, isohexane, 2-methylhexane, n-octane, cyclohexane, 1,1-dimethylcyclohexane, and mineral spirits and chlorinated hydrocarbons (e.g., trichloroethane and tetrachloromethane); and aromatic hydrocarbons such having 6 to 20 carbon atoms such as benzene, toluene, o-xylene, m-xylene, p-xylene, mixed xylene, ethylbenzene and n-propylbenzene. If desired, these diluents may be used as a mixture of two or more.

The suitable amount of the hydrotalcite of formula (1) or its surface-treated product is such as to bring the alkali value of the resulting composition to at least 250. Since one gram of the hydrotalcite has an alkali value of as high as about 1500 to 1700, the hydrotalcite or its surface-treated product can be used in an amount of, for example, at least about 15%, preferably about 17 to about 50%, based on the weight of the detergent-dispersant composition.

Addition of the hydrotalcite or its surface treated product to the oil-soluble sulfonate can be effected by adding a suspension, a cake or a dry powder of the hydrotalcite to the oil-soluble sulfonate, and uniformly dispersing it by a homogenizer, a jet agitator, etc., if required, volatilizing water or another solvent, and further if required, removing the precipitate by filtration.

The following Examples illustrate the present invention more specifically.

EXAMPLE 1

One kilogram of a powder of a hydrotalcite of the formula $Mg_5Al_2(OH)_{14}CO_3.4H_2O$ having a BET specific surface area of 21 $m^2/g$ and an average secondary particle size of 0.2 micron was added to 15 liters of warm water kept at about 60° C., and the mixture was strongly stirred by a stirrer. Then with vigorous stirring, about 1 liter of warm water (about 60° C.) having dissolved therein 54.5 g of sodium laurylbenzenesulfonate having a purity of 55% was added. After the addition, the mixture was maintained for about 30 minutes with stirring. It was then dehydrated, washed with water, dehydrated and dried. Then, 80 g of the resulting powder was added to 100 g of neutral magnesium alkylbenzenesulfonate (molecular weight 944) dissolved in 150 g of hexane, and the mixture was stirred for about 5 minutes by a jet agitator. The mixture was then filtered under reduced pressure, and the filtrate was obtained as a final product (detergent-dispersant additive). When the detergent-dispersant additive was left to stand at room temperature for 2 months, no precipitate formed. The additive had an alkali value of 410. The ratio of recovery of the hydrotalcite in the product was about 85%.

EXAMPLE 2

The suspension of the hydrotalcite coated with sodium laurylbenzenesulfonate obtained in Example 1 was centrifuged, and the resulting cake was taken in an amount of 70 g calculated as a dry product, and added to a diluted solution of oil-soluble magnesium alkylbenzenesulfonate having the same composition as in Example 1. The mixture was stirred for about 5 minutes by a jet agitator. The product was further distilled at about 150° C. to remove water. The resulting product was used directly as a detergent-dispersant additive because it yielded no precipitate. This additive had an alkali value of 425.

EXAMPLE 3

110 g of a powder of a hydrotalcite of the formula $Mg_8Al_2(OH)_{19.6}(CO_3)_{1.2}.6.2H_2O$ having a BET specific surface area of 26 $m^2/g$ and an average secondary particle size of 0.6 micron was added to a mixed solution of 200 g of heptane and 100 g of oil-soluble magnesium sulfonate, and the mixture was treated by a homogenizer. The product was filtered under reduced pressure, and the filtrate was used as a detergent-dispersant additive. The additive obtained had an alkali value of 336. The ratio of recovery of the hydrotalcite in the resulting product was about 52%.

EXAMPLE 4

One kilogram of a powder of a hydrotalcite of the formula $Mg_4Al_2(OH)_{13.2}(CO_3)_{0.4}.3H_2O$ having a BET specific surface area of 18 $m^2/g$ and an average secondary particle size of 0.16 micron was added to 20 liters of warm water kept at about 80° C., and the mixture was strongly stirred by a stirrer to disperse the hydrotalcite well. Then, 51 g of sodium oleate having a purity of 97% was added to about 1 liter of warm water kept at about 80° C. to dissolve it completely. The solution was then added to the dispersion of the hydrotalcite, and the mixture was stirred fully for about 30 minutes. The product was centrifuged. The resulting cake was added in an amount of 180 g calculated as a dry product to a mixed solution consisting of 100 g of oil-soluble magnesium sulfonate, 300 g of hexane and 200 g of toluene. The mixture was stirred for about 5 minutes by a jet agitator. The mixture was then filtered under reduced pressure, and the filtrate was distilled at about 150° C. to remove toluene and water to obtain a detergent-dispersant additive. The additive obtained had an alkali value of 465. The ratio of recovery of the hydrotalcite in the product was about 67%.

Comparative Example

Using 1 kg of a hydrotalcite of the formula $Mg_6Al_2(OH)_{11.8}(CO_3)_{1.1}.4H_2O$ having a BET specific surface area of 92 $m^2/g$ and an average secondary particle size of 7.2 microns, the same operation as in Example 1 was performed. The ratio of recovery of the hydrotalcite in the final product was about 5%.

What we claim is:

1. A detergent-dispersant composition for lubricating or fuel oils, said composition consisting essentially of (a) an amount effective as a detergent-dispersant of a hydrotalcite having a specific surface area, determined by the BET method, of up to about 60 $m^2/g$ and an average secondary particle size of up to about 5 microns, the hydrotalcite particles being untreated or sulface-treated with an anionic surface-active agent, and the hydrotalcite being represented by the following formula $$Mg_xAl_2(OH)_{6+2x-2y}(CO_3)_y.mH_2O$$

wherein x is a positive number represented by $3<x<20$, y is a positive number represented by $0<y<2$, and m is a positive number of up to 7, and (b) a hydrophobic dispersant or diluent.

2. The composition of claim 1 wherein the average secondary particle size of the hydrotalcite is up to about 1 micron.

3. The composition of claim 1 wherein the anionic surface-active agent is selected from the group consisting of alkali metal salts of higher fatty acids and alkali metal salts of hydrocarbon sulfonic acids.

4. The composition of claim 1 wherein the hydrophobic dispersant is selected from the group consisting of salts of hydrophobic sulfonic acids, alkyl phenates and high-molecular-weight carboxylic acid salts.

5. The composition of claim 1 wherein the amount of the hydrotalcite is not less than 15% by weight based on the weight of the composition.

6. The composition of claim 1 wherein the hydrophobic diluent is selected from the group consisting of optionally halogenated aliphatic or alicyclic hydrocarbons and aromatic hydrocarbons.

7. The composition of claim 1 wherein the specific surface area of the hydrotalcite is up to about 40 $m^2/g$.

* * * * *